US006722328B2

(12) United States Patent
Quinn, Jr.

(10) Patent No.: US 6,722,328 B2
(45) Date of Patent: Apr. 20, 2004

(54) CONTROL METHOD FOR DUAL DEPENDENT VARIABLE CAM TIMING SYSTEM

(75) Inventor: Stanley B. Quinn, Jr., Elmhurst, IL (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/313,069

(22) Filed: Dec. 6, 2002

(65) Prior Publication Data

US 2003/0230267 A1 Dec. 18, 2003

Related U.S. Application Data

(60) Provisional application No. 60/389,187, filed on Jun. 17, 2002.

(51) Int. Cl.[7] ..... F01L 1/34

(52) U.S. Cl. ..... 123/90.17; 123/90.15; 123/90.16

(58) Field of Search ..... 123/90.15, 90.17, 123/90.11, 90.16

(56) References Cited

U.S. PATENT DOCUMENTS 5,184,578 A 2/1993 Quinn, Jr. et al. ..... 123/90.17
5,289,805 A * 3/1994 Quinn et al. ..... 123/90.17
6,367,435 B1 4/2002 Okui et al. ..... 123/90.15
6,516,759 B2 * 2/2003 Takahashi et al. ..... 123/90.15

FOREIGN PATENT DOCUMENTS

DE 10127928 A1 12/2001 ..... F02D/13/02
DE 101 38048 A1 6/2002 ..... F01L/1/344
EP 1 013 899 A2 12/1999 ..... F01L/1/344

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

In a dual dependent variable cam timing system, the desired intake global phase is reached by directly controlling the global phase of exhaust VCT phaser and controlling the local phase of intake VCT phaser. The global intake set point specified by an engine controller is converted into a local intake set point first, then passed through a set point filter, and compared with the measured local intake phase. The difference (error signal) is passed through a PI controller and a phase compensator, which have the same control structures as those of exhaust VCT phaser control, to form a control signal.

15 Claims, 6 Drawing Sheets

CONTROL METHOD FOR DUAL DEPENDENT VARIABLE CAM TIMING SYSTEM

REFERENCE TO RELATED APPLICATIONS

This application claims an invention which was disclosed in Provisional Application No. 60/389,187, filed Jun. 17, 2002, entitled "CONTROL METHOD FOR DUAL DEPENDENT VARIABLE CAM TIMING SYSTEM". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, pertains to a dual dependent VCT system, wherein desired intake global phase is reached by direct controlling the global phase of exhaust VCT phaser and controlling the local phase of intake VCT phaser.

2. Description of Related Art

Internal combustion engines have become increasingly complex, as features such as variable cam timing (VCT) and active noise cancellation are included. For example, using VCT, the angular displacement, or phase of a camshaft, relative to the crankshaft to which it is drivably connected, is dynamically altered to bring about changes in engine characteristics, such as fuel economy, power, or emission. Typically, there is a feedback loop in which the desired values of such engine characteristics are measured against their existing values, and changes are effected inside the engine in response to discrepancies. To accomplish this, modern automobiles usually have a control module (or more than one) having a microcomputer that constantly analyzes data fed into it from various parts of the engine and other parts of the automobile and ambient conditions (exhaust gas sensors, pressure and temperature sensors, etc.) and emits signals in response to such data. For example, in regard to VCT, as changes occur in engine and external conditions, the angular displacement between the cam shaft and the crank shaft that drives it is altered.

Referring to FIG. 1, a prior art feedback loop 10 is shown. The control objective of feedback loop 10 is to have a spool valve in a null position. In other words, the objective is to have no fluid flowing between two fluid holding chambers of a phaser (not shown) such that the VCT mechanism at the phase angle given by a set point 12 with the spool 14 stationary in its null position. This way, the VCT mechanism is at the correct phase position and the phase rate of change is zero. A control computer program product which utilizes the dynamic state of the VCT mechanism is used to accomplish the above state.

The VCT closed-loop control mechanism is achieved by measuring a camshaft phase shift $\theta_0$ 16, and comparing the same to the desired set point r 12. The VCT mechanism is in turn adjusted so that the phaser achieves a position which is determined by the set point 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point r 12 and phase shift 20) is non-zero.

The spool 14 is moved toward a first direction (e.g. right) if the phase error is negative (retard) and to a second direction (e.g. left) if the phase error is positive (advance). It is noted that the retarding with current phase measurement scheme gives a larger value, and advancing yields a small value. When the phase error is zero, the VCT phase equals the set point r 12 so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase between a cam shaft and a crankshaft is defined as the time from successive crank-to-cam pulses, divided by the time for an entire revolution and multiplied by 360. degree. The measured phase may be expressed as $\theta_0$ 16. This phase is then supplied to the control law 18 for reaching the desired spool position.

A control law 18 of the closed-loop 10 is described in U.S. Pat. No. 5,184,578 and is hereby incorporate herein by reference. A simplified depiction of the control law is shown in FIG. 2. Measured phase 26 is subjected to the control law 18 initially at block 30 wherein a Proportional-Integral (PI) process occurs. PI process is the sum of two sub-processes. The first sub-process includes amplification; and the second sub-process includes an integration. Measured phase is further subjected to phase compensation at block 32, where control signal is adjusted to increase the overall control system stability before it is sent out to drive the actuator, in the instant case, a variable force solenoid.

To avoid confusion, the following two terms, global phase and local phase, are introduced. Global phase is defined as the relative angular position for both the intake and exhaust VCT phasers with respect to crankshaft. Local phase is defined as the relative angular position for only the intake VCT phaser with respect to exhaust VCT phaser.

A cam phaser control method, which is described in U.S. Pat. No. 5,184,578, is hereby incorporated herein by reference, describes a negative feedback loop. As can be appreciated, the loop is analogous to FIGS. 1 and 2. The loop is briefly described here merely to incorporate the concept of global and local phases respectively. The exhaust global set point is passed through a set point filter and compared with the measured exhaust global phase. The difference is then passed through a PI controller and a phase compensator. The calculated value is then added by a null value. The final result is the control value to be sent to either a PWM driving circuit or a current driving circuit to move the control actuator.

The performance of an internal combustion engine can be improved by the use of dual camshafts, one shaft to operate the intake valves of the various cylinders of the engine and the other shaft to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

It is desirous, therefore to provide a dual dependent VCT system, wherein desired intake global phase is reached by direct controlling the global phase of exhaust VCT phaser and controlling the local phase of intake VCT phaser.

SUMMARY OF THE INVENTION

A system and method are provided using a pair of dual dependent cam shafts to improve feed back control.

A system and method are provided by directly controlling the global phase of exhaust VCT phaser and controlling the local phase of intake VCT phaser, the desired intake global phase is reached and a desired control signal created.

Accordingly, a variable cam timing (VCT) control system used in an internal combustion engine with the system having a dual dependent cam shaft configuration is provided. In the dual dependent cam shaft configuration, an intake cam shaft is dependent upon an exhaust cam shaft. The control system includes: a) an exhaust phaser engaging the exhaust cam shaft; b) an intake phaser engaging the intake cam shaft, the movement of the intake cam shaft being dependent upon the movement of the exhaust cam shaft; c) a first feedback loop for correcting errors relating to the intake phaser, the first feedback loop including a measured intake phase signal, being used to compare with a local intake set point and being used to generate an error signal used by the first feedback loop; and d) a second feedback loop for correcting errors relating to the exhaust phaser, the second feedback loop including a measured exhaust phase signal.

Accordingly, in a variable cam timing (VCT) control system used in an internal combustion engine, with the system having a dual dependent cam shaft configuration is provided. In the dual dependent cam shaft configuration, an intake cam shaft is dependent upon an exhaust cam shaft. A method comprising the steps is provided. The steps includes: providing an exhaust phaser engaging the exhaust cam shaft; providing an intake phaser engaging the intake cam shaft, the movement of the intake cam shaft being dependent upon the movement of the exhaust cam shaft; providing a first feedback loop for correcting errors relating to the intake phaser, the first feedback loop including a measured intake phase signal, being used to compare with a local intake set point and being used to generate an error signal used by the first feedback loop; providing a second feedback loop for correcting errors relating to the exhaust phaser, the second feedback loop including a measured exhaust phase signal; and using the measured exhaust phase signal, correcting both a global intake set point and an exhaust set point, thereby providing a more accurate correction to the dual dependent variable cam timing system.

DETAILED DESCRIPTION OF THE INVENTION

In a dual dependent Variable Cam Timing (VCT) device, the exhaust VCT phaser is driven by the crankshaft, while the intake VCT phaser is driven by the exhaust VCT phaser. Thus the intake phase is determined by both exhaust angular position with respect to the crankshaft and intake angular position with respect to the exhaust phaser. The exhaust VCT phaser can be controlled using the same method as dual independent VCT control, but intake VCT phaser control must be modified accordingly.

Figure 1:
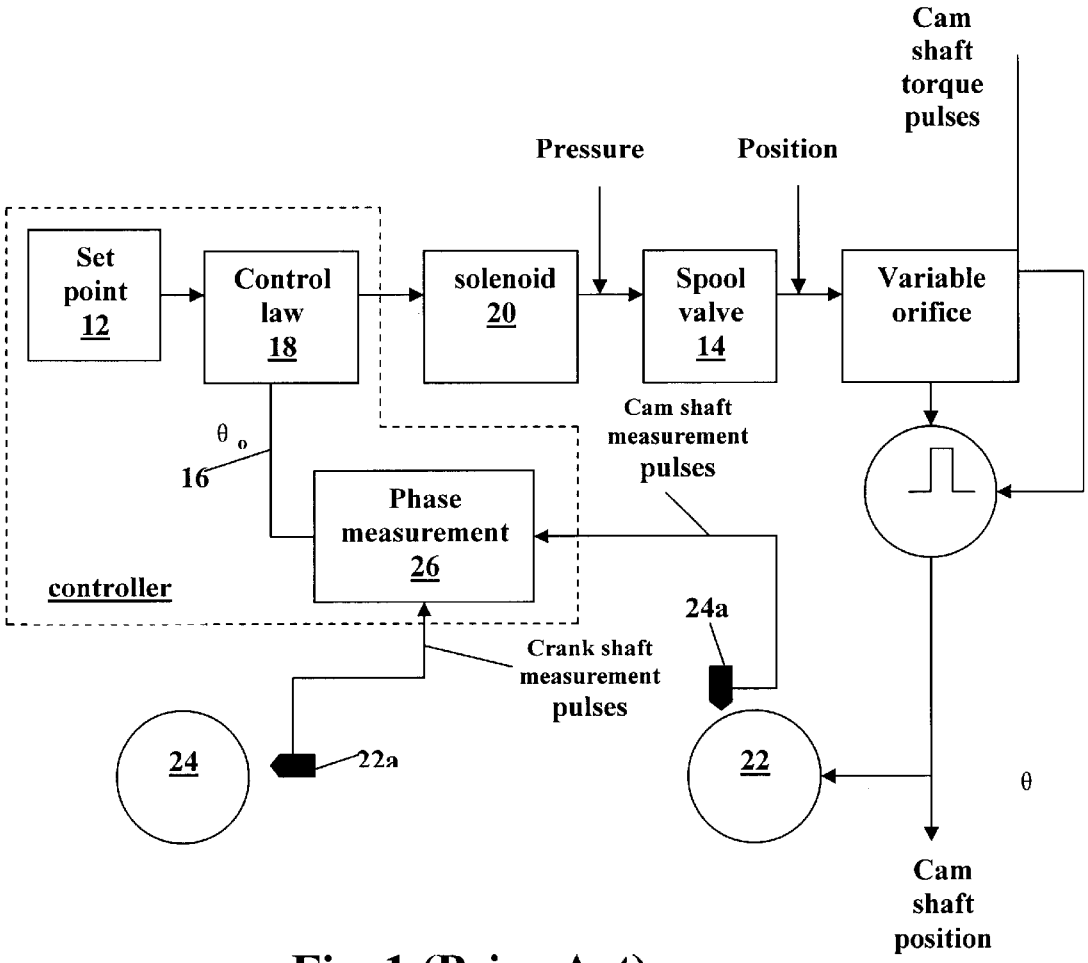
Fig. 1 (Prior Art)
FIG. 1 shows a prior art control loop.
Figure 2:
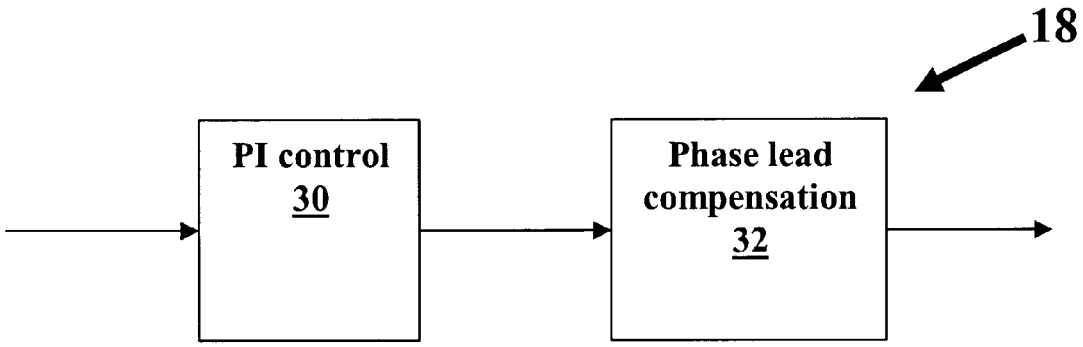
Fig. 2 (Prior Art)
FIG. 2 shows a depiction of the control law of FIG. 1.
Figure 3:
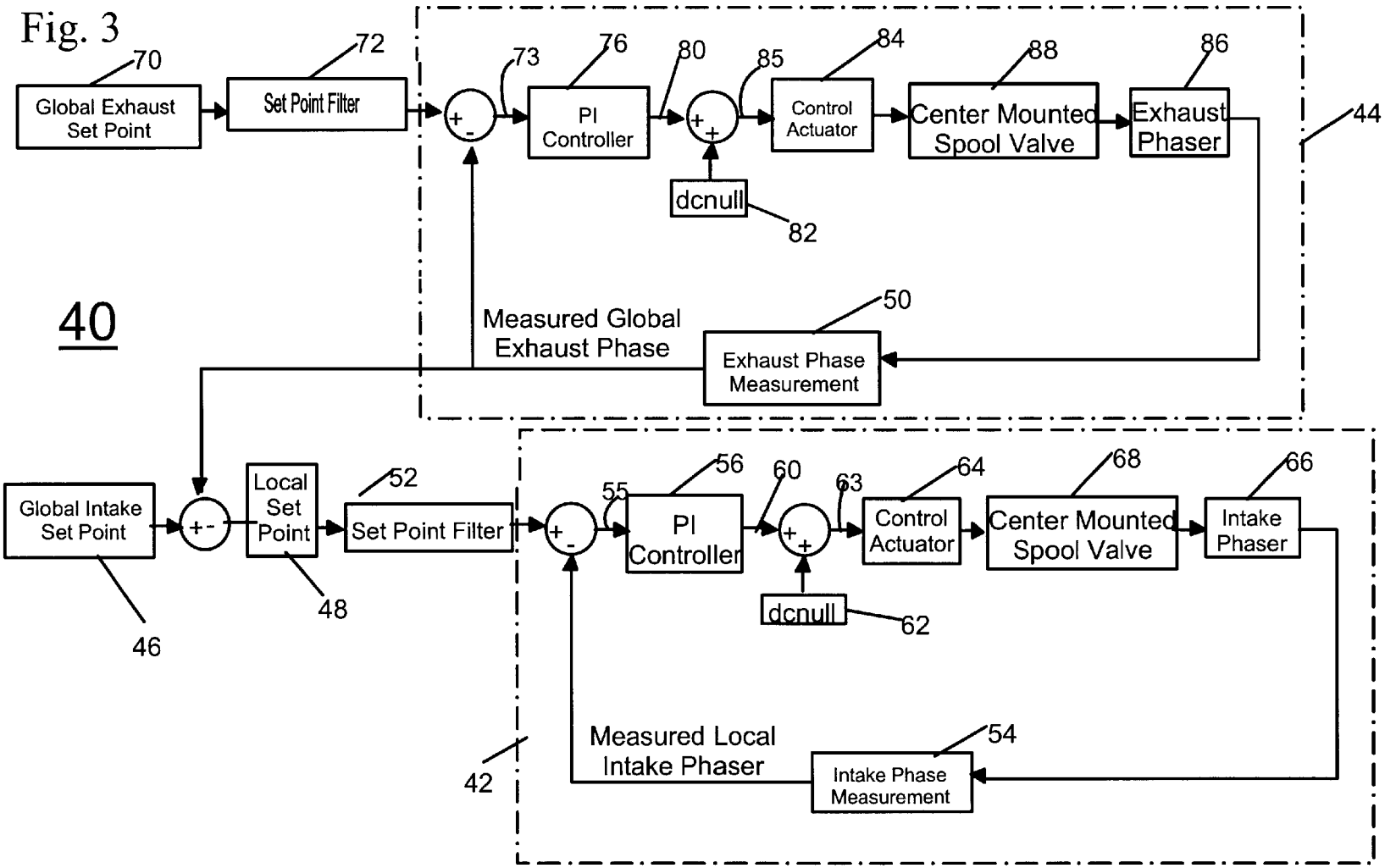
FIG. 3 shows a diagram depicting the present invention.

In the present invention, the desired intake global phase is reached by directly controlling the global phase of the exhaust VCT phaser and controlling the local phase of intake VCT phaser as shown in FIG. 3.

Referring to FIG. 3, a diagram 40 depicting the present invention is shown. Diagram 40 is further subdivided into a first loop 42 and a second loop 44. First loop 42 is a negative feedback loop for an intake phaser control. Second loop 44 is a negative feedback loop for an exhaust phaser control. Initially, the global intake set point 46 specified by an engine controller (not shown) is first converted into local intake set point 48. Local set point 48 is defined as follows.

Local intake set point 48=global intake set point 46−measured exhaust global phase 50

The local intake set point 48 is passed through a set point filter 52, and then compared with the measured local intake phase 54. The difference (error signal 55) is passed through a PI controller 56 to form a first signal 60. Signal 60 and a null duty cycle signal 62 are summed up and the summation forms a first control signal 63 which drives a control actuator 64. Actuator 64 drives an exhaust phaser 64 via a center mounted spool valve. The position of the intake phaser is measured by the intake phase measurement block 54. A measured value of the intake phase is, in turn, feed back for a correction of local intake set point 48 upon proper filtering.

Turning now to the second loop 44, the controller determines a global exhaust set point 70 which is subject to filtering by set point filter 72. The filtered set point is compared with the local measured exhaust phase 50. The filtered exhaust set point goes through a process similar in structure to what goes through local set point 48. In other words, the difference (error signal 73) is passed through a PI controller 76 and may also pass through a phase compensator (not shown) to form a second signal 80. Second signal 80 and a null duty cycle signal 82 are summed up and the summation forms a second control signal 85 which drives a control actuator 84. Actuator 84 drives an exhaust phaser 84 via a center mounted spool valve 88. The position of the exhaust phaser 84 is measured by the exhaust phase measurement block 54. A measured value of the exhaust phase is fed back for a correction of global exhaust set point 70 upon proper filtering. As pointed out supra, the measured global exhaust phase 50 is used to generate local intake setpoint.

In order to clarify further upon the present invention, a measurement and expression of the global and local phase are discussed in the following paragraphs. The measurement method of global phase and local phase can be expressed as follows by way of an example.

Figure 4:
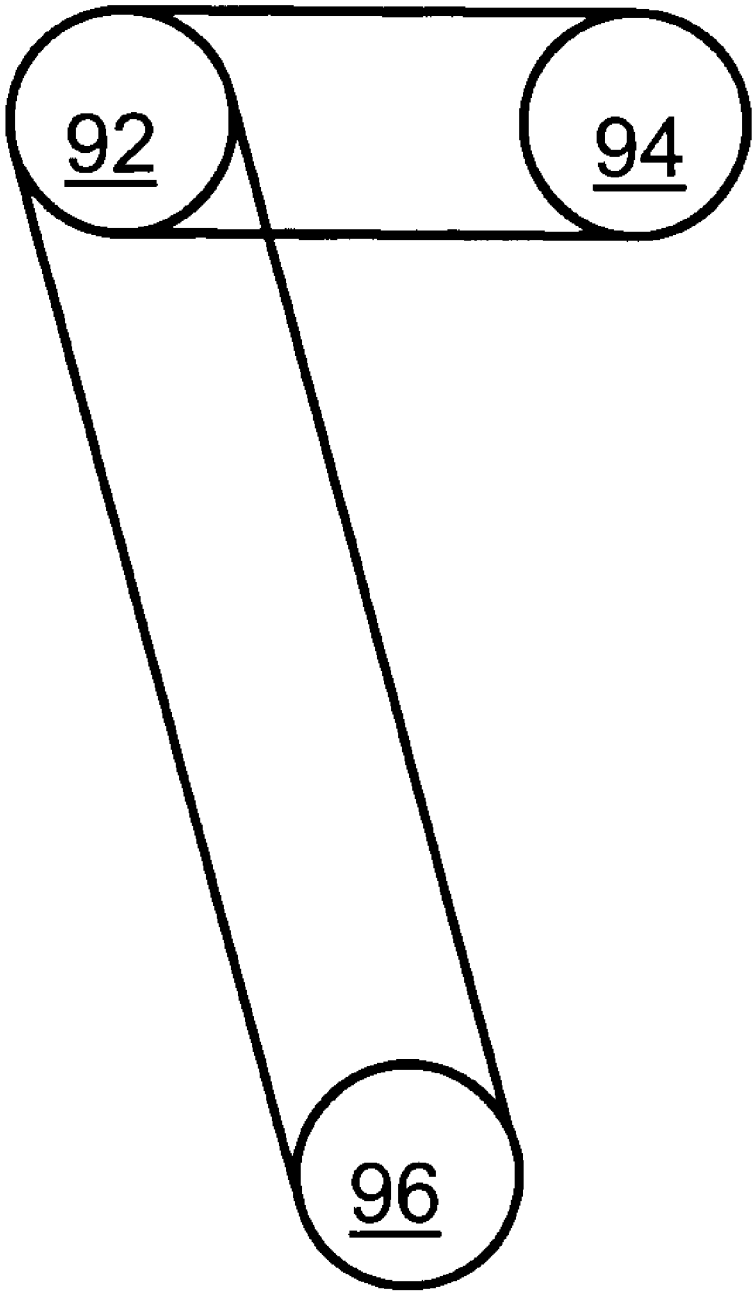
FIG. 4 shows the coupling relationships between intake cam, exhaust cam, and crank shafts.

Referring to FIG. 4, in a V configuration engine with dependent intake cam shafts 90 is provided. The exhaust camshaft 92 drives the intake camshaft 94 and so an intake cam position is dependent upon the exhaust cam position. The driving force for the exhaust cam shaft 92 comes from crank shaft 96. Because of the dependency, a different method to determine the phase of the intake cams is required. Each of the cam shafts has a phaser (not shown) attached thereto respectively.

A pair of dependent VCT subsystems exists in the present invention. They are a first VCT subsystem and a second VCT subsystem respectively. The first VCT subsystem includes at least one exhaust phaser (not shown) for adjusting the angular relationship with crank shaft 96. The second VCT subsystem includes at least one intake phaser (also not shown) for adjusting the angular relationship with crank shaft 96 by adjusting the angular position against the exhaust cam shaft with the knowledge of the relative angular relationship between the exhaust cam shaft and the crankshaft. As can be appreciated, the intake cam shaft is coupled to the exhaust cam shaft 92 thus the intake cam being indirectly coupled to the crank shaft 96. Therefore, the pair of VCT subsystems is dependent in this aspect. Coupling means are provided for coupling exhaust cam shaft 92 with crank shaft 96, and coupling exhaust cam shaft 92 with intake cam shaft 94. The coupling means can be engine timing chain, timing belt, and gear drive, etc.

Figure 5:
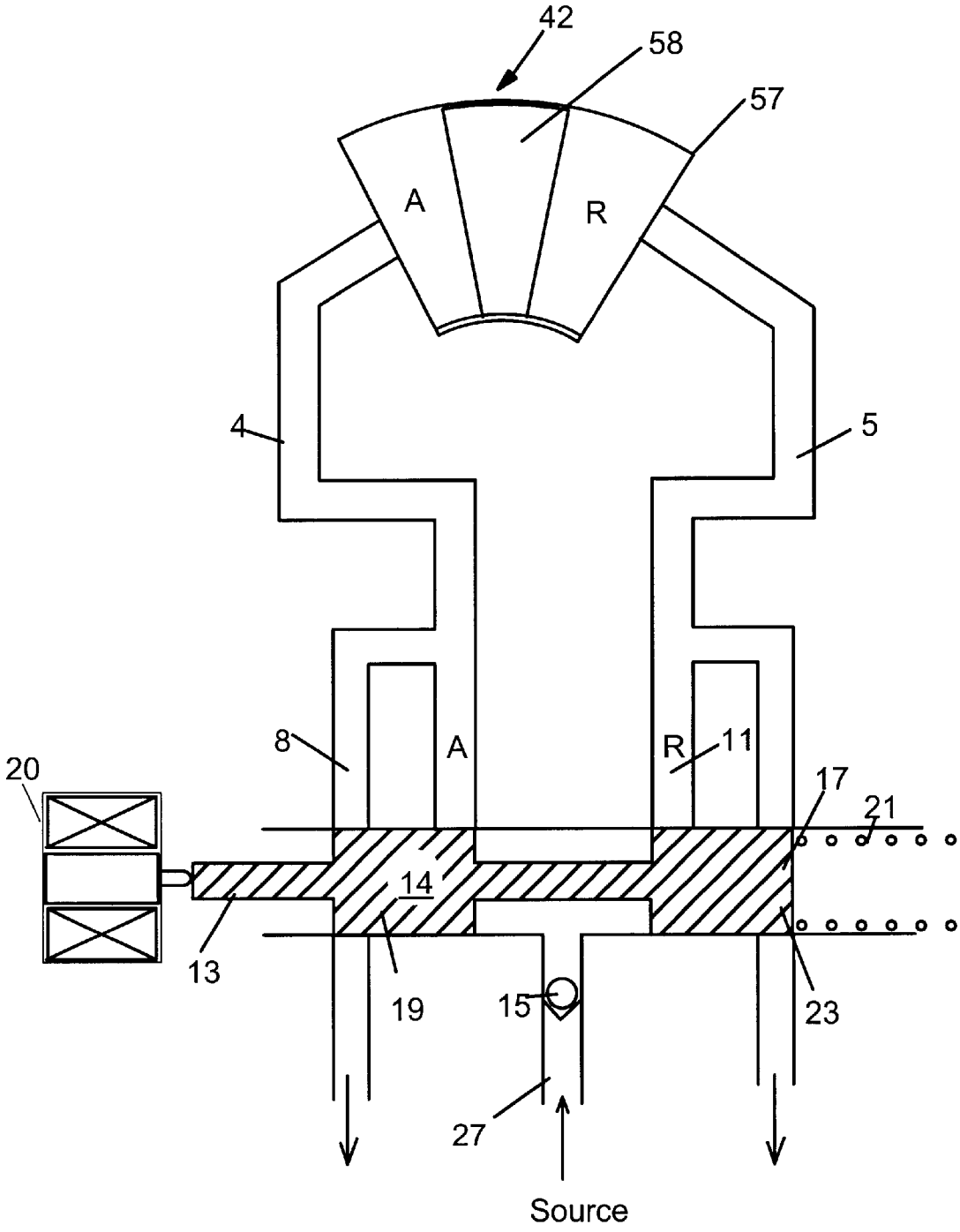
FIG. 5 shows a schematic depicting one type of phaser suitable for the present invention.

The phaser described in FIG. 4 may be any type of phaser that adjusts the angular relationship of two rotating shafts with the phaser disposed in-between. FIG. 5 shows an exemplified version of a phaser that may be applied to the present invention.

Referring to FIG. 5, a schematic depicting one type of phaser is shown. The phaser is at null position. Solenoid 20 engages spool valve 14 by exerting a first force upon the same on a first end 13. The first force is met by a force of equal strength exerted by spring 21 upon a second end 17 of spool valve 14 thereby maintaining the null position. The spool valve 14 includes a first block 19 and a second block 23 each of which blocks fluid flow respectively.

The phaser 42 includes a vane 58, a housing 57 using the vane 58 to delimit an advance chamber A and a retard chamber R therein. Typically, the housing and the vane 58 are coupled to crank shaft (not shown) and cam shaft (also not shown) respectively. Vane 58 is permitted to move relative to the phaser housing by adjusting the fluid quantity of advance and retard chambers A and R. If it is desirous to move vane 58 toward the advance side, solenoid 20 pushes spool valve 14 further right from the original null position such that liquid in chamber A drains out along duct 4 through duct 8. The fluid further flows or is in fluid communication with an outside sink (not shown) by means of having block 19 sliding further right to allow said fluid communication to occur. Simultaneously, fluid from a source passes through duct 27 and is in one-way fluid communication with duct 11 by means of one-way valve 15, thereby supplying fluid to chamber R via duct 5. This can occur because block 23 moves further right causing the above one-way fluid communication to occur. When the desired vane position is reached, the spool valve is commanded to move back left to its null position, thereby maintaining a new phase relationship of the crank and cam shaft.

Before proceeding to the calculations of the dual dependent variable cam timing system, a review of the calculation of phase measurement for exhaust or intake cams for a nondependent camshaft drive is listed below.

Phase=(ΔT/T*Crank Angle)−Zphase

Where:

Phase is phase in degrees referenced to crank

ΔT is the time from a falling edge crank tooth signal to the next occurring falling edge cam tooth signal, the time measured in microseconds or fractional microseconds.

T is the time between 2 applicable consecutive crank teeth falling edge signals, the time measured in microseconds or fractional microseconds. T is always greater than ΔT.

Crank Angle=360/number of applicable evenly spaced crank teeth, examples are:

For 2 crank teeth, Crank Angle=180 degrees

For 3 crank teeth, Crank Angle=120 degrees

For 4 crank teeth, Crank Angle=90 degrees

Zphase is a run time calculated offset value, determined under controlled conditions to insure that mathematically the cam tooth falling edge signals occur within a small degree amount after the crank tooth falling edge signal and within the window provided by the 1st and 2nd edges of the crank.

The phase measurement for the intake cams 94 of a dual dependent V engine is similar in some aspects but different in others. Because the intake cam position is dependent on the exhaust cam position, the intake cam position can be referenced to the exhaust cam 92.

Phase=(ΔT/T*Crank Angle)−Zphase

Where:

Phase is the intake cam 94 phase in degrees referenced to the exhaust cam 92 phase.

ΔT is the time from a falling edge exhaust cam tooth signal to the next occurring falling edge intake cam tooth signal, the time measured in microseconds or fractional microseconds.

T is identical to the above.

Crank Angle is identical to the above.

Zphase is a run time calculated offset value, which is determined under controlled conditions to insure that mathematically the intake cam tooth falling edge signal occurs a small degree amount, (2.5° in this case) after the exhaust tooth falling edge signal and within the window provided by the 1st and 2nd edges of the exhaust cam signals.

Figure 6:
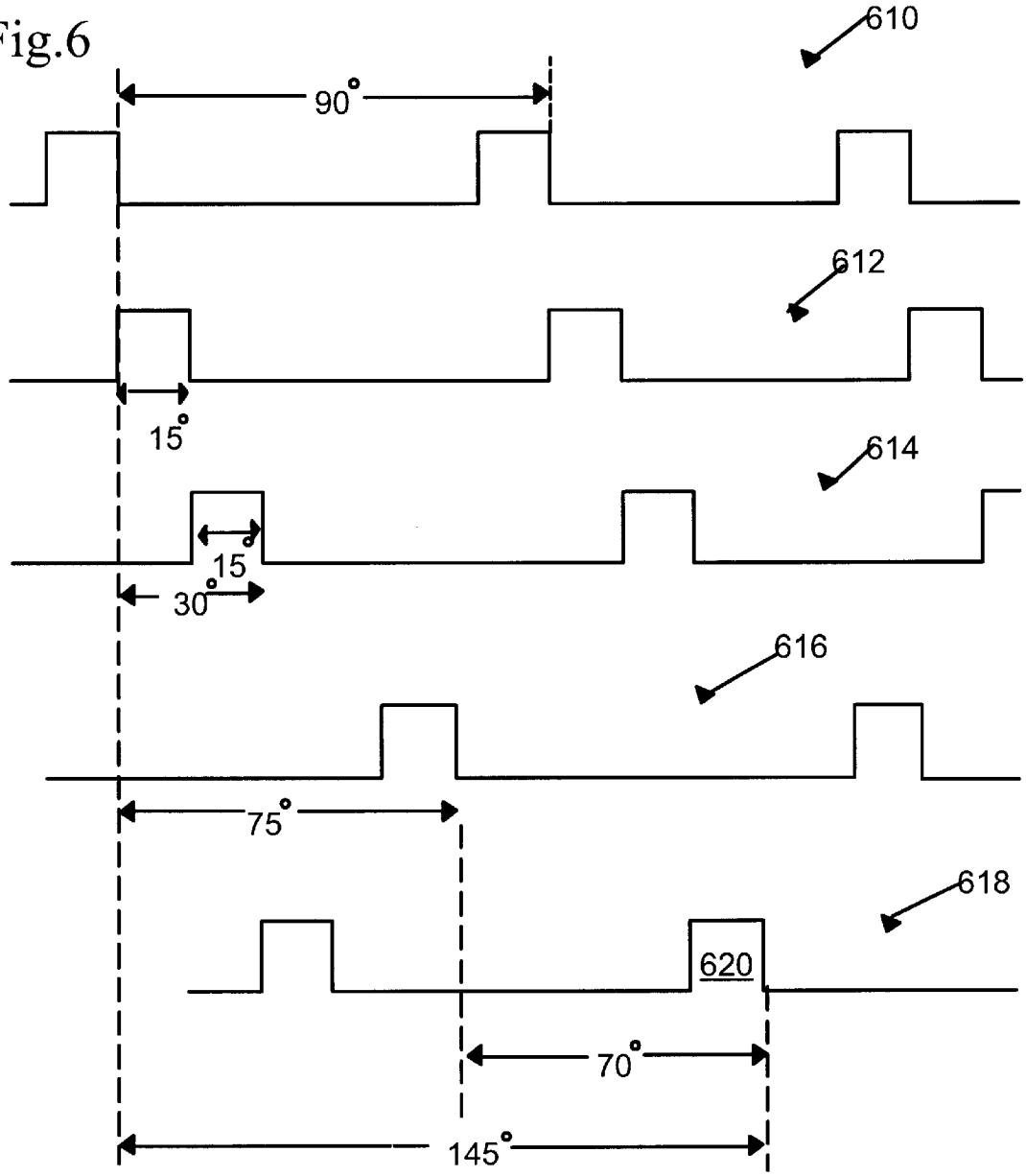
FIG. 6 shows some examples of the relationships between tooth waveforms applicable to the present invention

FIG. 6 shows some examples of the relationships between tooth waveforms applicable to the present invention which is different from known independent cams. The relationship is different in that intake cam is dependent both upon the exhaust cam and the crank shafts.

Referring to FIG. 6, a timing diagram for a dual dependent VCT system is shown. Waveform 610 depicts a sensed crank signal having 4 pulses per revolution. One sensed crank pulse corresponds to two sensed cam teeth signals. Therefore, 4 crank teeth correspond to 8 cam teeth.

Waveform 612 depicts a sensed exhaust cam signal having 8 pulses per revolution. The first exhaust cam tooth falling edge lags or retards 15 degrees in relation to the falling edge of the first crank tooth.

Waveform 614 depicts a sensed dependent intake cam signal having 8 pulses per revolution. Because of the dependency, the first intake cam tooth falling edge lags or retards 15 degrees in relation to the falling edge of the first exhaust cam tooth. At the same time, the first intake cam tooth falling edge lags or retards 30 degrees in relation to the falling edge of the first crank tooth. In other words, because of the dual cam structure, increased time lag occurs for intake cam. As can be appreciated, the prior art approach for a single cam system of 90 degree limit is further restricted. Therefore, the present invention formulates a novel expression incorporating novel features and elements are provided to address the above limited restriction.

At this juncture, total time lag is still within the 90 degree limit. The following two waveforms shows the relationships between waveforms when the time lag or retardation exceeds the limit.

Waveform 616 depicts an identical sensed exhaust cam signal having 8 pulses per revolution an waveform 612. The first exhaust cam tooth falling edge lags or retards 75 in relation to the falling edge of the first crank tooth. Waveform 618 depicts an identical sensed dependent intake cam signal having 8 pulses per revolution. Because of the dependency, the first intake cam tooth falling edge lags or retards 70 in relation to the falling edge of the first exhaust cam tooth. At the same time, the first intake cam tooth 620 falling edge lags or retards 145 in relation to the falling edge of the first crank tooth.

It should be noted that the instant invention teaches using the exhaust phase measurement to correct both the global exhaust set point and the global intake set point. The global intake set point, upon correction, forms a local set point which is related to and dependent upon the exhaust loop. Furthermore, intake phase measurement is used at the local intake set point juncture instead of global intake setpoint juncture.

One embodiment of the invention is implemented as a program product for use with a computer system such as, for example, the schematic diagram of FIG. 3 and described below. The program(s) of the program product defines functions of the embodiments and can be contained on a variety of signal-bearing media. Illustrative signal-bearing media include, but are not limited to: (i) information permanently stored on non-writable storage media (e.g., read-only memory devices within a computer such as CD-ROM disks readable by a CD-ROM drive); (ii) alterable information stored on writable storage media (e.g., floppy disks within a diskette drive or hard-disk drive); (iii) the memory of a vehicle controller such as EPROM or (iv) information conveyed to a computer by a communications medium, such as through a computer or telephone network, including wireless communications. The latter embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA)or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing (VCT) control system used in an internal combustion engine, said system having a dual dependent cam shaft configuration, wherein an intake cam shaft is dependent upon an exhaust cam shaft, comprising:

a) an exhaust phaser engaging said exhaust cam shaft;

b) an intake phaser engaging said intake cam shaft, the movement of said intake cam shaft being dependent upon the movement of said exhaust cam shaft;

c) a first feedback loop for correcting errors relating to said intake phaser, said first feedback loop including a measured intake phase signal, being used to compare with a local intake set point and being used to generate an error signal used by the first feedback loop; and d) a second feedback loop for correcting errors relating to said exhaust phaser, said second feedback loop including a measured exhaust phase signal, wherein said measured exhaust phaser signal is used for adjustments of both said exhaust phaser and said intake phaser.

2. The system of claim 1, wherein said error signal is used by a control law to generate a first control signal.

3. The system of claim 2, wherein said measured exhaust phase signal is used to compare with an exhaust setpoint and generate an error signal that is used by said control law to generate a second control signal.

4. The system of claim 3, wherein said second control signal is also used to compare with said global intake set point to generate said local intake setpoint.

5. The system of claim 1, further comprising a controller for controlling inputs to both the first feedback loop and the second feedback loop.

6. The system of claim 1, further comprising a crankshaft coupled with said exhaust cam shaft.

7. The system of claim 6, further comprising coupling means for coupling said exhaust cam shaft to said crank shaft by a first coupling meanings.

8. The system of claim 1, further comprising coupling means for coupling said exhaust cam shaft to said intake cam shaft by a second coupling means.

9. In a variable cam timing (VCT) control system used in an internal combustion engine, said system having a dual dependent cam shaft configuration, wherein an intake cam shaft is dependent upon an exhaust cam shaft, a method comprising the steps of:

providing an exhaust phaser engaging said exhaust cam shaft;

providing an intake phaser engaging said intake cam shaft, the movement of said intake cam shaft being dependent upon the movement of said exhaust cam shaft;

providing a first feedback loop for correcting errors relating to said intake phaser, said first feedback loop including a measured intake phase signal, being used to compare with a local intake set point and being used to generate an error signal used by the first feedback loop;

providing a second feedback loop for correcting errors relating to said exhaust phaser, said second feedback loop including a measured exhaust phase signal; and using said measured exhaust phase signal, correcting both a global intake set point and an exhaust set point, thereby providing a more accurate correction to said dual dependent variable cam timing system.

10. The method of claim 9, wherein the error signal is used by a control law to generate a first control signal.

11. The method of claim 10, wherein said measured exhaust phase signal is used to compare with an exhaust setpoint and generate said error signal that is used by said control law to generate a second control signal.

12. The method of claim 11, wherein said second control signal is also used to compare with said global intake set point to generate said local intake setpoint.

13. The method of claim 9 further comprising controlling inputs to both the first feedback loop and the second feedback loop using a controller.

14. The method of claim 9 further comprising coupling said exhaust cam shaft with a crank shaft by a first coupling means.

15. The method of claim 9 further comprising coupling said exhaust cam shaft with said intake cam shaft by a second coupling means.

* * * * *